United States Patent [19]

Armstrong et al.

[11] Patent Number: 4,805,863

[45] Date of Patent: Feb. 21, 1989

[54] BRACE AND SHELF SUPPORT ASSEMBLY

[75] Inventors: Bruce Armstrong, Pittsburgh; William Pfeifer, Springdale, both of Pa.

[73] Assignee: Armstrong Store Fixture Corporation, Pittsburgh, Pa.

[21] Appl. No.: 32,827

[22] Filed: Mar. 30, 1987

[51] Int. Cl.[4] ..... A47G 29/02

[52] U.S. Cl. ..... 248/243; 108/108; 211/187; 211/193

[58] Field of Search ..... 248/243, 242, 235; 211/187, 193; 108/108; 16/DIG. 13

[56] References Cited

U.S. PATENT DOCUMENTS

| | | | |
|---|---|---|---|
| 661,755 | 11/1900 | Cheheyl . | |
| 874,014 | 12/1907 | Kurtzon . | |
| 1,847,486 | 3/1932 | Keil . | |
| 2,195,579 | 4/1940 | Murdock | 248/242 |
| 2,483,758 | 10/1949 | Douglas | 248/242 |
| 2,960,254 | 11/1960 | Kiba | 16/DIG. 13 X |
| 3,485,382 | 12/1969 | Larson | 211/150 |
| 4,211,379 | 7/1980 | Morgan et al. | 248/243 X |

FOREIGN PATENT DOCUMENTS

| | | | |
|---|---|---|---|
| 11361 | 1/1928 | Australia | 248/243 |

*Primary Examiner*—Alvin C. Chin-Shue
*Assistant Examiner*—David L. Talbott
*Attorney, Agent, or Firm*—Parmelee, Miller, Welsh & Kratz

[57] ABSTRACT

A brace for a shelf support extending outwardly from an upright includes an elongated member having first and second ends, a first means on the first end of the elongated member for releasably securing the brace to an upright at a position below the shelf support, a second means on the second end of the elongated member for releasably securing the brace to the shelf support, the second means being pivotally connected to the elongated member so as to provide adjustablility of the angle between the elongated member and the second means.

7 Claims, 2 Drawing Sheets

BRACE AND SHELF SUPPORT ASSEMBLY

BACKGROUND OF THE INVENTION

The invention relates to a brace for a shelf support extending outwardly from an upright and, more particularly, to such a brace having a means pivotally connected to one end of an elongated member for releasably securing the elongated member to a shelf support so as to provide adjustability of the angle between the elongated member and the securing means.

A wide variety of types of braces for shelf supports are known in the art. Such braces are limited in their use because one end of the brace must conform to the design of the upright to which the brace is to be attached and the other end must conform to the design of the shelf support. Particularly, uprights are generally designed with openings, such as slats or bores, for attaching braces and shelf supports at spaced horizontal and vertical intervals so that the braces and shelf supports can be attached to the upright at many locations. It can be readily understood that such designs can have varied distances between the shelf support and brace attachments to the upright, varied distances between the upright and brace attachment to the shelf support, varied lengths of the brace, and/or varied angles at which the brace and lower edge of the shelf support extend from the upright, and varied angles at which the brace and lower edge of the shelf support meet. Thus, in order for a brace to be useful with a variety of upright and shelf support designs, the brace must be adaptable to designs having the aforementioned varied distances and angles.

U.S. Pat. Nos. 661,755 to Cheheyl, 874,014 to Kurtzon and 1,847,486 to Keil describe a bracket that is adjustable by varying the degree to which the lower end of the brace is threaded into a bore in the upright, thus varying the effective length of the brace.

U.S. Pat. No. 3,485,382 to Larson, discloses a brace for a shelf support that is pivotally attached to an upright and shelf support in order to enable the angle between the shelf support and the upright to be adjusted. Thus, the angle between the brace and the shelf support can also be adjusted. However, the angles between the shelf support and the upright, between the brace and the shelf support and the brace and the upright are adjustable due to the design of the upright and the shelf support. The brace by itself is not adaptable to be used at different angles.

Thus, it is desired to have a brace for a shelf support that is adjustable for use with a variety of shelf support and upright designs.

SUMMARY OF THE INVENTION

The present invention is a brace for a shelf support extending outwardly from an upright, and a shelf support assembly using such a brace. The brace includes an elongated member having first and second ends. A first means is disposed on the first end of the elongated member for releasably securing the brace to an upright at a position below the shelf support. A second means is disposed on the second end of the elongated member for releasably securing the brace to the shelf support and is pivotally connected to the elongated member so as to provide adjustability of the angle between the elongated member and the second means.

Preferably, the second means for releasably securing the brace to the shelf support comprises a U-shaped channel member having a slot therein, and the shelf support is received in the slot and supported by the U-shaped channel member.

The adjustability of the angle between the elongated member and the second means of the brace of the invention enables the brace of the invention to be used with a variety of upright and shelf support configurations. Particularly, the angle between the elongated member and the second means of the brace can be adjusted to enable the brace and lower edge of the shelf support to meet at a variety of angles and still have the portion of the lower edge of the shelf support that is inserted within the slot of the U-shaped channel member be flush with the lower edge of the slot. This increases the support provided by the brace to the shelf support and, as a consequence, increases the load that can be borne by the shelf support.

DETAILED DESCRIPTION OF THE PREFERRED EMBODIMENTS

The brace 10 of the present invention for a shelf support 12 that extends outwardly from an upright 14 includes an elongated member 16. The elongated member 16 can have any one of a number of suitable shapes, including a rod having a circular cross-section.

Figure 1:
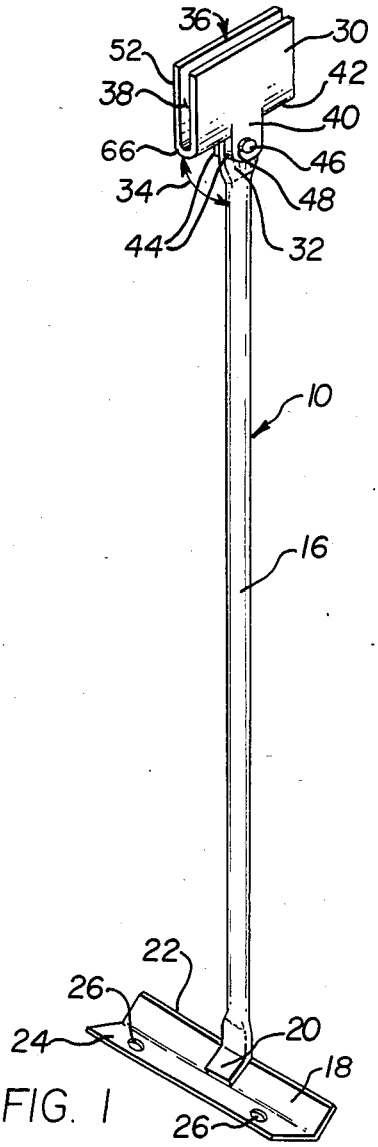
FIG. 1 is an elevational view of a brace constructed in accordance with the present invention.
Figure 2:
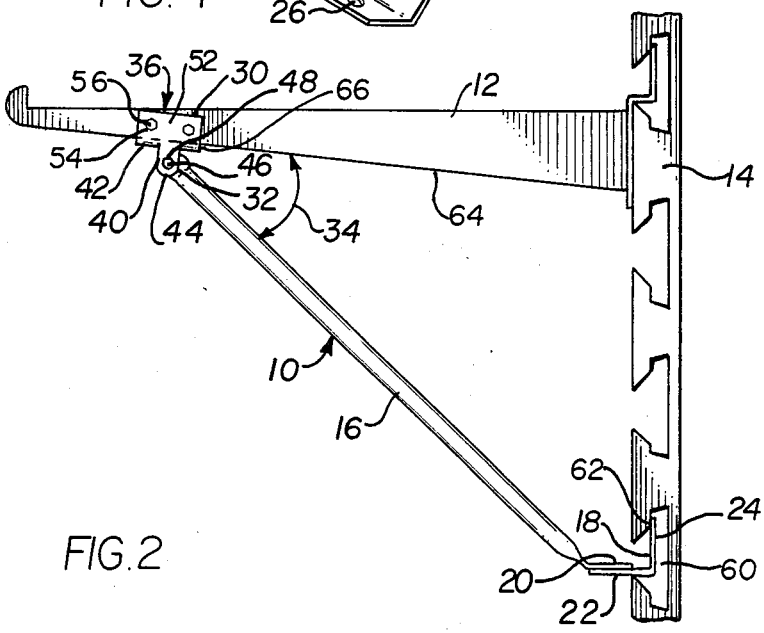
FIG. 2 is a side plan view of the brace shown in FIG. 1 attached to an upright and supporting a shelf support extending from the upright.
Figure 3:
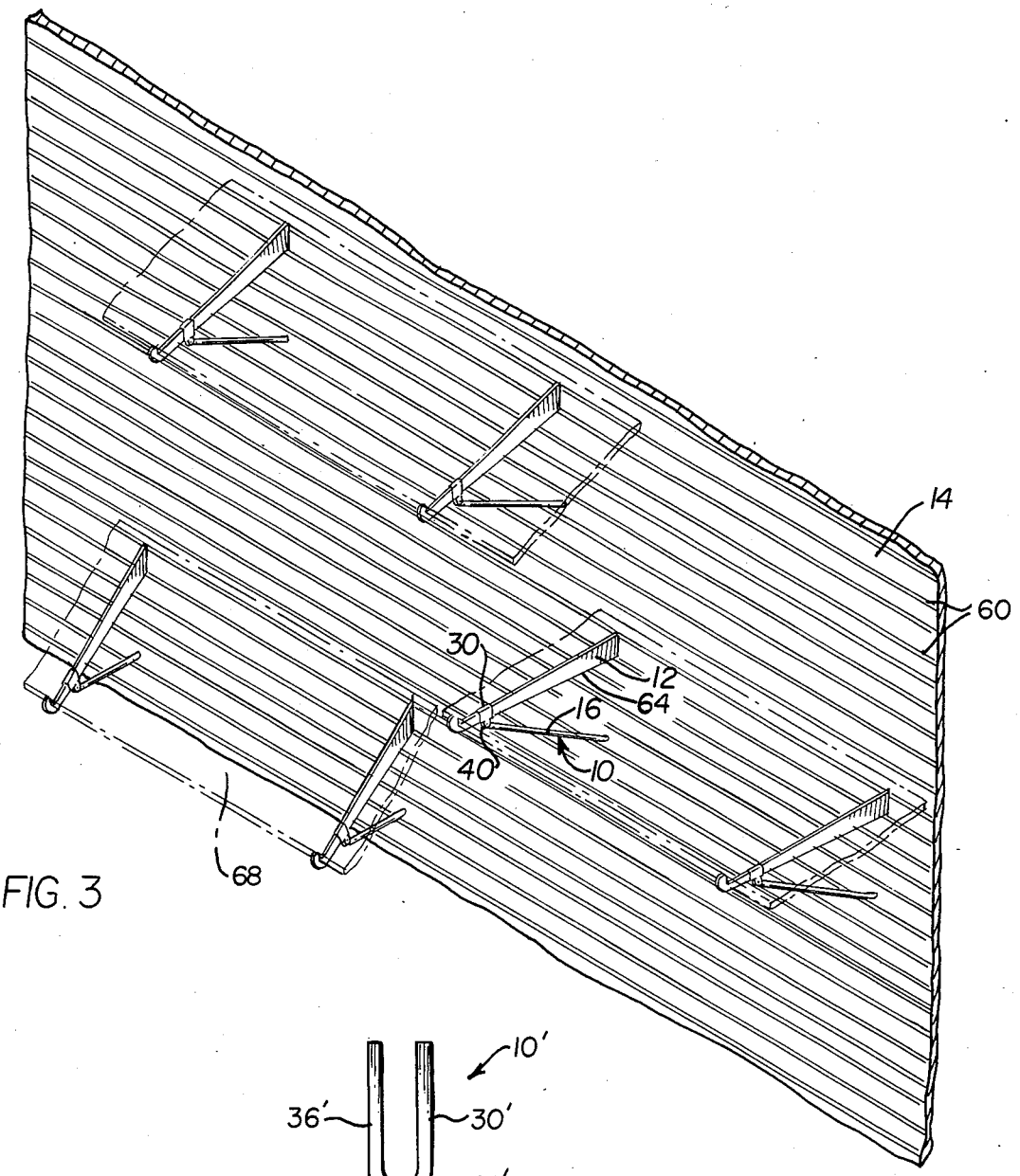
FIG. 3 is a composite of several elevational views of the brace shown in FIG. 1 attached to a slat wall and supporting a shelf support extending from the slat wall.

The elongated member 16 has a first means 18 on a first end 20 for releasably securing the brace 10 to the upright 14. The first means 18 can be any suitable apparatus that will coact with the upright 14 to secure the brace 10 to the upright 14. The first means 18 illustrated in the Figures includes a V-shaped member 22 which is attached to the first end 20 of the elongated member 16. One leg 24 of the V-shaped member 22 may include bores 26 through which screws (not shown) can be threaded if desired to secure the brace 10 to the upright 14. As shown in FIGS. 2 and 3, the V-shaped member 22 is particularly suited for attachment to an upright 14 such as a slat wall.

The elongated member has a second means 30 on a second end 32 for releasably securing the brace 10 to the shelf support 12. The second means 30 is pivotally connected to the second end 32 of the elongated member 16 so as to provide adjustability of the angle 34 between the elongated member 16 and the second means 30. As shown in the Figures, the preferred second means 30 includes a U-shaped channel member 36 having a slot 38 therein for receiving and supporting a shelf support 12. The U-shaped channel member 36 includes a bifurcated stem 40 extending from the lower portion 42 of the U-shaped channel member 36. The second end 32 of the elongated member 16 is disposed between the bifurcated portions 44 of the stem 40. The U-shaped channel member 36 is secured to the elongated member 16 by a fastening means such as a rivet 46, pin or bolt disposed through bores 48 in the bifurcated portions 44 of the stem 40 of the U-shaped channel member 36 and a bore 50 (FIG. 4) in the elongated member 16. One side 52 of the U-shaped channel member 36 further includes bores 54 through which screws 56 or bolts are threaded to tightly secure the shelf support 12 within the slot 38.

Figure 4:
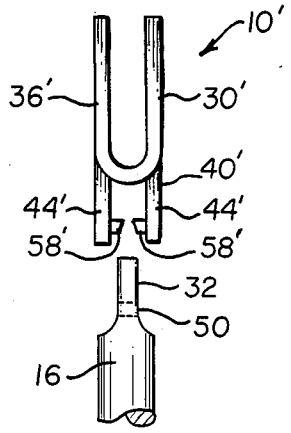
FIG. 4 is an end view of a portion of a brace of constructed in accordance with the present invention illustrating a second embodiment thereof.

In an alternative embodiment of the invention, illustrated in FIG. 4, the bifurcated portions 44' of the stem 40' of the U-shaped channel member 36' of the brace 10' include inwardly extending projections 58' which can be disposed within the bore 50 in the second end 32 of the elongated member 16 to secure the U-shaped channel member 36' to the elongated member 16.

The brace 10 of the invention is particularly suited for use with an upright 14, such as a slat wall. Slat walls include a plurality of vertically spaced horizontal grooves 60 in which shelf supports 12 and braces 10 are inserted and secured to the slat wall. Preferably, as shown in FIG. 2, the grooves 60 have a T-shaped cross-section. Thus, in order to secure the brace 10 of the invention to an upright 14, such as a slat wall, and a shelf support 12 extending outwardly from the upright 14, the leg 24 of the V-shaped member 22 is positioned and secured within a groove 60 in the upright 14 below the shelf support 12 so that the leg 24 abuts the inside edge 62 of the groove 60. The U-shaped channel member 36 is pivoted about the rivet 46 with respect to the elongated member 16 and adjust the angle 34 between the elongated member 16 and the U-shaped channel member 36. The lower edge 64 of the shelf support 12 is inserted within the slot 38 of the U-shaped channel member 36 so that the portion of the lower edge 64 of the shelf support 12 that is inserted within the slot 38 of the U-shaped channel member 36 is flush with the lower edge 66 of the slot 38. The screws 56 through the bores 54 in the side 52 of the U-shaped channel member 36 are then tightened against the shelf support 12 to secure the shelf support 12 within the slot 38 of the U-shaped channel member 36. Once a plurality of shelf supports 12 are secured to the upright 14 and are spaced horizontally apart from each other, the shelf supports 12 are able to support a shelf 68 (shown in phantom in FIG. 3).

Because the angle 34 between the elongated member 16 and the second means 30 is adjustable, the use of the brace 10 is not conditioned upon the angle that the brace 10 meets the lower edge 64 of the shelf support 12.

What is claimed is:

1. A brace for a shelf support, said shelf support having a lower edge, and extending outwardly from a slat wall, said brace comprising:

an elongated member having first and second ends;

a V-shaped member attached to said first end of said elongated member for releasably securing said brace to said slat wall at a position below said shelf support; and a U-shaped channel member connected to said second end of said elongated member for releasably securing said brace to said shelf support, said U-shaped channel member having a slot therein with a lower edge for receiving and supporting said lower edge of said shelf support, said U-shaped channel member being pivotally connected to said elongated member so as to provide adjustability of the angle between said elongated member and said U-shaped channel member, such that the lower edge of the shelf support when inserted within the slot of said U-shaped channel member is flush with and supported by the U-shaped channel member at the lower edge of said slot.

2. The brace as defined in claim 1 wherein said U-shaped channel member has releasable fastening means thereon to fasten said shelf support securely within said U-shaped channel member.

3. The brace as defined in claim 1 wherein said U-shaped channel member includes a lower portion and a stem having two bifurcated portions extending from said lower portion, said bifurcated portions of said stem being adapted to receive said second end of said elongated member therebetween and said bifurcated portions and said second end of said elongated member having cooperating bores therethrough through which a releasable fastening means is disposed to secure said U-shaped channel member to said second end of said elongated member.

4. The brace as defined in claim 1 wherein said U-shaped channel member includes a lower portion and a stem having two bifurcated portions extending from said lower portion, said bifurcated portions of said stem being adapted to receive said second end of said elongated member therebetween; said bifurcated portions having inwardly extending projections, and said second end of said elongated member having a bore into which said projections are disposed to secure said U-shaped channel member to said second end of said elongated member.

5. A shelf support assembly comprising:

a slat wall;

a shelf support having a lower edge and extending outwardly from said slat wall; and a brace for said shelf support comprising:

an elongated member having first and second ends, a V-shaped member attached to said first end of said elongated member for releasably securing said brace to said slat wall at a position below said shelf support, and a U-shaped channel member connected to said second end of said elongated member for releasably securing said brace to said shelf support, said U-shaped channel member having a slot therein with a lower edge for receiving and supporting said lower edge of said shelf support, said U-shaped channel member being pivotally connected to said elongated member so as to provide adjustability of the angle between said elongated member and said U-shaped channel member, such that the lower edge of the shelf support when inserted within the slot of said U-shaped channel member is flush with and supported by the U-shaped channel member at the lower edge of said slot.

6. The shelf support assembly as defined in claim 5 wherein said U-shaped channel member includes a lower portion and a stem having two bifurcated portions extending from said lower portion, said bifurcated portion of said stem being adapted to receive said second end of said elongated member therebetween and said bifurcated portions and said second end of said elongated member having cooperating bores therethrough through which a fastening means is disposed to secure said U-shaped channel member to said second end of said elongated member.

7. The shelf support assembly as defined in claim 5 wherein said U-shaped channel member includes a lower portion and a stem having two bifurcated portions extending from said lower portion, said bifurcated portions of said stem being adapted to receive said second end of said elongated member therebetween; said bifurcated portions having inwardly extending projections and said second end of said elongated member having a bore into which said projections are disposed to secure said U-shaped channel member to said second end of said elongated member.

* * * * *